US010421315B2

(12) United States Patent
Roy

(10) Patent No.: US 10,421,315 B2
(45) Date of Patent: Sep. 24, 2019

(54) DEVICE FOR TENSIONING A CANVAS ON A FRAME AND KIT FOR ASSEMBLING A FRAME FOR CANVAS

(71) Applicant: Francois Roy, Lévis (CA)

(72) Inventor: Francois Roy, Lévis (CA)

( * ) Notice: Subject to any disclaimer, the term of this patent is extended or adjusted under 35 U.S.C. 154(b) by 0 days.

(21) Appl. No.: 15/796,783

(22) Filed: Oct. 28, 2017

(65) Prior Publication Data

US 2018/0072093 A1 Mar. 15, 2018

Related U.S. Application Data

(63) Continuation-in-part of application No. 29/573,095, filed on Aug. 2, 2016, now Pat. No. Des. 798,697, (Continued)

(30) Foreign Application Priority Data

Oct. 31, 2016 (FR) ..... 16 70647
Jan. 29, 2017 (FR) ..... 17 70089

(51) Int. Cl.
*B44D 3/18* (2006.01)
*B25B 5/00* (2006.01)
*D05C 1/02* (2006.01)

(52) U.S. Cl.
CPC ..... *B44D 3/185* (2013.01); *B25B 5/00* (2013.01); *B44D 3/18* (2013.01); *D05C 1/02* (2013.01)

(58) Field of Classification Search
CPC ..... B44D 3/18; B44D 3/185; B25B 5/067; B25B 5/101; B25B 5/142; B25B 5/00; (Continued)

(56) References Cited

U.S. PATENT DOCUMENTS 69,447 A 10/1867 Kellog
1,916,022 A * 6/1933 Shull ..... B44D 3/185 160/374.1

(Continued)

FOREIGN PATENT DOCUMENTS

DE 122640 C 6/1990
DE 10302038 A1 7/2004

(Continued)

*Primary Examiner* — Ismael Izaguirre
(74) *Attorney, Agent, or Firm* — Quickpatents, LLC; Kevin Prince

(57) ABSTRACT

The invention relates to a device for tensioning a canvas on a frame, which is for assembling two bars the ends of which comprise a groove. The device comprises: an optional sheath intended to be immobilized in a groove; a spacer comprising a central portion from which extend two lateral portions each having a bearing face coming to abut against the bottom of the sheath; a tensioner comprising a central portion from which extend securing means for securing the tensioner to the bars, via the sheath; a connecting member for connecting the spacer to the tensioner, and means for bringing the spacer closer to the tensioner, wherein the spacer being brought closer to the tensioner will cause each bar to translate along its longitudinal axis so as to space the bars apart from each other while keeping them perpendicular to each other.

20 Claims, 8 Drawing Sheets

Related U.S. Application Data which is a continuation-in-part of application No. 29/559,309, filed on Mar. 26, 2016, now Pat. No. Des. 796,943.

(58) Field of Classification Search
CPC ... B25B 5/14; A47G 1/10; B41F 15/34; B41F 15/36
See application file for complete search history.

(56) References Cited

U.S. PATENT DOCUMENTS

| | | | | | |
|---|---|---|---|---|---|
| 2,149,985 | A | | 3/1939 | Tepper | |
| 2,491,600 | A | | 12/1949 | Bearce | |
| 2,538,138 | A | * | 1/1951 | Webster | E06B 3/9646 403/401 |
| 2,838,081 | A | * | 6/1958 | Larson | B25B 5/142 269/249 |
| 3,127,695 | A | | 4/1964 | Driscoll | |
| 3,133,375 | A | | 5/1964 | Myren | |
| 3,230,872 | A | * | 1/1966 | De Groot | B41F 15/36 101/127.1 |
| 3,625,274 | A | | 12/1971 | Johnson | |
| 3,914,887 | A | | 10/1975 | Newman | |
| 3,978,905 | A | | 9/1976 | de Lama | |
| 4,050,498 | A | | 9/1977 | Lucchetti | |
| 4,076,438 | A | * | 2/1978 | Bos | E06B 3/982 403/297 |
| 4,161,977 | A | | 7/1979 | Baslow | |
| 4,301,853 | A | | 11/1981 | Vidal | |
| 4,373,279 | A | | 2/1983 | Abel | |
| 4,432,150 | A | | 2/1984 | Swonger | |
| 4,519,151 | A | | 5/1985 | Johnson | |
| 4,565,020 | A | | 1/1986 | Beatriz | |
| 4,829,685 | A | | 5/1989 | Persson | |
| 4,947,922 | A | | 8/1990 | Stobart | |
| 5,076,162 | A | | 12/1991 | Goin | |
| 5,271,171 | A | | 12/1993 | Smith | |
| 5,918,392 | A | | 7/1999 | Bates | |
| 6,138,741 | A | | 10/2000 | Stobart | |
| 6,497,268 | B1 | | 12/2002 | Peppett | |
| 6,520,240 | B2 | | 2/2003 | Sooklaris | |
| 7,735,541 | B2 | | 6/2010 | Ocampo | |
| 8,069,783 | B2 | | 12/2011 | Hall | |
| 8,122,624 | B2 | | 2/2012 | Vaz | |
| 8,307,880 | B2 | | 11/2012 | Ocampo | |
| 8,490,545 | B2 | | 7/2013 | Hall | |
| 8,752,312 | B2 | | 6/2014 | Vaz | |
| 8,793,910 | B2 | | 8/2014 | Froio | |
| 2004/0244924 | A1 | | 12/2004 | Peppett | |
| 2008/0277078 | A1 | | 11/2008 | Sawyer | |
| 2009/0057364 | A1 | | 3/2009 | Ocampo | |
| 2012/0227293 | A1 | | 9/2012 | Vaz | |
| 2014/0060761 | A1 | | 3/2014 | Evers | |

FOREIGN PATENT DOCUMENTS

| | | | |
|---|---|---|---|
| FR | 2937901 | A1 | 5/2010 |
| GB | 1437399 | A | 5/1976 |
| NL | 7612062 | A | 5/1978 |

* cited by examiner

Fig.3b
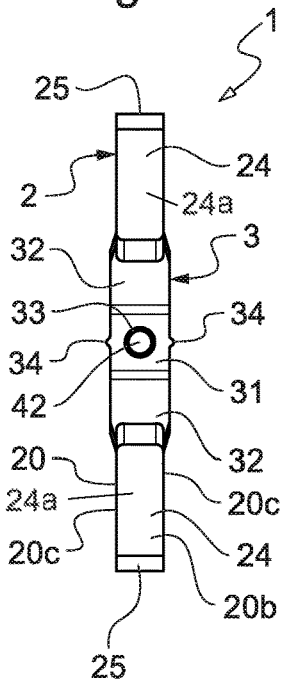
Fig.3a
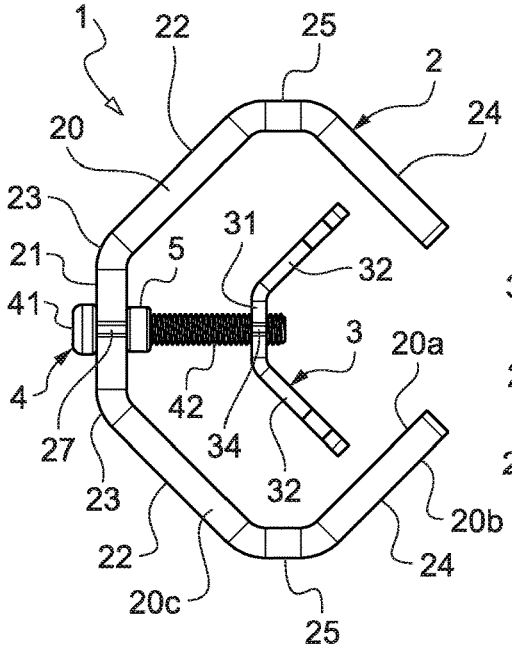
Fig.3c
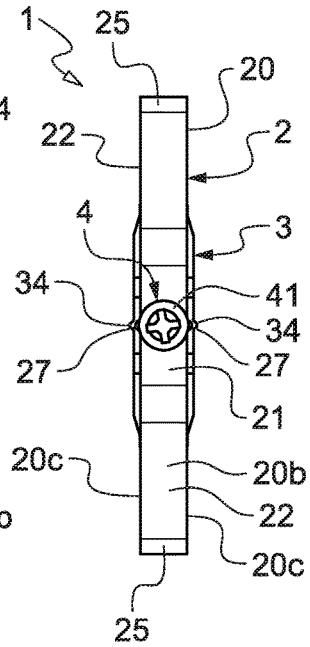
Fig.3d
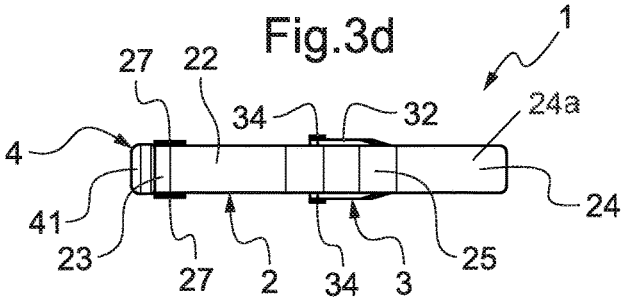
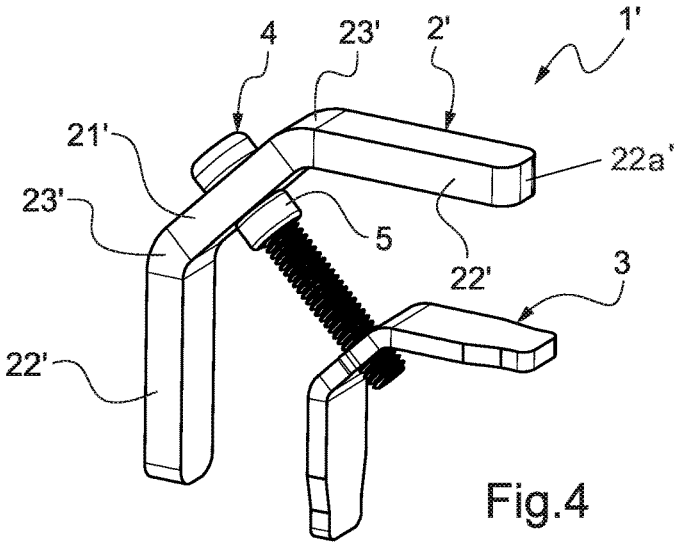
Fig.4

DEVICE FOR TENSIONING A CANVAS ON A FRAME AND KIT FOR ASSEMBLING A FRAME FOR CANVAS

CROSS-REFERENCE TO RELATED APPLICATIONS

This application claims the benefit of French Patent Application 1670647, filed on Oct. 31, 2016, and French Patent Application 1770089, filed on Jan. 29, 2017, both incorporated herein by reference. This application is further a Continuation-in-Part of US Design Patent Application 29/573,095, filed on Aug. 2, 2016, which is in-turn a Continuation-in-Part of U.S. Design Patent Application 29/559,309, filed on Mar. 26, 2016, now U.S. Design Pat. D796,943, issued on Sep. 12, 2017, both incorporated herein by reference.

STATEMENT REGARDING FEDERALLY SPONSORED RESEARCH AND DEVELOPMENT

Not Applicable.

FIELD OF THE INVENTION

The present invention relates to the field of wooden frames for painter's canvas and printed canvas, and relates specifically to a device for tensioning a canvas on a frame, which devices allows to assemble two perpendicular adjacent frame bars and to tension a canvas on an assembled frame using four such devices, one at each corner of the frame.

DISCUSSION OF RELATED ART

The solution for tensioning a canvas on a frame that is the easiest in term of tools consist in applying on a frame a piece of canvas of a larger size than the frame, then folding down the canvas along the four bars which forms the frame, while pulling on the canvas, for instance using a stretching plier, securing the canvas along the bars, for instance by stapling, while leaving free the canvas at the corner, and then, at each corner of the frame, folding back on itself the free part of the canvas so as to form folds which overlap, and then stapling the folds to the frame.

The above solution has the drawbacks that it requires the use of a stretching plier and that it is relatively time-consuming to implement if one wishes to correctly tension the canvas, since the user should tension it correctly all along the bars before securing it thereto. This must particularly be the case when the frames are of a larger size.

Furthermore, this solution supposes either that the user already has an assembled frame, or that the user assembles himself the four bars of the frame, which is an additional work which once again requires tools and is not easy for frames of larger sizes.

SUMMARY OF THE INVENTION

The present invention aims at providing a device for tensioning a canvas on a frame made of wood, which devices allows to assemble easily and quickly two adjacent bars of a frame and to also tension a canvas easily and quickly, and yet also precisely, on an assembled frame using devices according to the present invention.

The present invention relates to a device for tensioning a canvas on a frame, preferably made of wood, intended to assemble perpendicularly to each other two frame bars, whose ends are for this purpose beveled at 45-degrees for a single-bevel type assembly of the two frame bars and each end has a groove opening onto said end and having a bottom, preferably perpendicular to the longitudinal axis of the respective bar, said device being characterized by the fact that it comprises:

- a spacer, which comprises a central portion having two ends from each of which extends a lateral portion intended to be received within the groove of a respective bar among the two bars, each lateral portion having a bearing face intended to be, in the use position in which both bars are assembled, in contact with the bottom of the groove,
- a tensioner, which comprises a central portion from which extends securing means adapted to cooperate, in the use position, to secure the tensioner to the two bars, while allowing a translational movement of each bar with respect to the tensioner, along the longitudinal axis of said bar, the tensioner being positioned on the inner side of the assembled bars,
- a connecting member for connecting the spacer to the tensioner, and
- means for bringing the spacer closer to the tensioner, said means being adapted to move, in the use position, toward the tensioner the spacer which is on the outer side of the assembled bars, wherein said movement of the spacer will cause each bearing face to push on the bottom of the respective groove, and thus to translate each bar along the longitudinal axis of the bar so as to space both bars apart from each other while keeping them perpendicular to each other.

In an alternate embodiment of the invention an inner part is included having a base from which extends at least a wing, the inner part being configured to be, in a use position, immobilized within the groove of a bar with the base being in contact with the bottom of the groove. In such an embodiment the at least one wing has at least one guiding formation, wherein the lateral portion of the spacer is intended to cooperate with the inner part immobilized within the groove, the bearing face of each lateral portion in contact with the base of the inner part, the securing means of the tension adapted to cooperate in the use position with the guiding formation. As such, movement of the spacer will cause each bearing face to push on the base of the inner part, and so on the bottom of the respective groove.

In order to avoid any ambiguity, it is underlined here that the expression "inside of the assembled bars" indicates the area, so-called inner area, which is delimited by four bars assembled to form the frame, while the expression "outside of the assembled bars" indicates the area, so-called outer area, which is located on the outer of the frame. Thus, the expression "inner side of the assembled bars" means that the tensioner is closer to the inner area than to the outer area, while the expression "outer side of the assembled bars" means that the spacer is closer to the outer area than to the inner area.

The inner part could be formed by a monobloc part or by a plurality of parts made integral with one another.

According to the alternate embodiment, the inner part is formed as a globally U-shaped sheath, having thus a bottom forming said base and two wings, at least one of the two wings being provided with a guiding formation.

In this alternate embodiment, it is beneficial to provide that:

the tensioner has a flared U-shape, whose bottom is constituted by the central portion of the tensioner and whose two legs are each formed by a lateral portion which has two lateral edges and extends from a respective end of the central portion, said securing means being formed by said two lateral portions, and the at least one guiding formation is sized so as to allow a respective side edge of a lateral portion of the tensioner to slide relative to said guiding formation.

Advantageously, each wing comprises a guiding formation with which a respective side edge of a lateral portion of the tensioner will cooperate, which allows the tensioner to be made integral with the bars in a balanced manner along the two side edges of its lateral portion.

The or each guiding formation can take any suitable form for allowing the lateral portion of the tensioner to slide relatively to the guiding formation. The guiding formation could thus be formed as a rail, having any cross section provided that it will match the form of the free edge of the lateral portion of the tensioner so as to allow said sliding.

Preferably, each wing comprises a guiding formation formed by a cutout provided in the respective wing, each cutout extending along a direction perpendicular to the bottom of the sheath and opening onto the free edge of the respective wing, each cutout being sized so as to allow a respective lateral edge of a lateral portion of the tensioner to slide in said cutout.

The sheath can further be provided with apertures arranged in the bottom and at least one of the wings.

The inner part, if applicable formed by a sheath, can be sized so as to be interference fitted in the groove of a bar.

Whether or not the inner part is sized for an interference fit in the groove of a bar, advantageously the inner part can be provided with at least one securing member adapted to secure the inner part to the groove of the respective bar, the at least one securing member preferably being a screw or a tooth, in particular sharp, extending outwardly from the base of the inner part.

In particular, in the case of a sheath provided with a plurality of apertures as indicated above, the device can comprise a plurality of securing members, each one formed by a material strip which extends transversely to a respective one of said apertures and which is bent at right angle outwardly.

It is underlined here that the present invention is not limited to an inner part formed by a globally U-shaped sheath. For instance, it would be possible to provide an inner part formed by a T-profile, namely with a single wing extending perpendicularly from the longitudinal centerline of the base, the wing and the base being flat. The wing could extend over the entire length of the base or only over a portion thereof. Here too, the at least one guiding formation can take any suitable form: for instance, it can consist in the wing itself, or in a cutout similar to that of the preferred embodiment described above, or in a rail arranged on a face of the wing or in two rails arranged each on a respective face of the wing. With such a configuration of the inner part, the securing means of the tensioner and the spacer will be adapted to be complementary to the inner part. For instance, in the case where the guiding formation consist in the wing itself, one could thus provide a flared U-shaped tensioner as indicated above, but the lateral portions of which each comprise a rectilinear cutout sized so as to form a sliding connection with the wing when the tensioner is placed in the groove of the bar, and likewise an aperture could be provided in the lateral portions of the spacer so as to let the wing of the inner part pass when the spacer is placed in the groove of the bar.

According to a particular embodiment of the spacer, the central portion of the spacer has in its center a smooth through hole, the central portion of the tensioner has in its center a threaded through hole which is aligned, in the use position, with said smooth through hole, the connecting member being a screw having a screw head and a threaded shank portion sized to extend in a freely rotating and slidable manner in the smooth through hole of the spacer and then to be threadably engaged with the threaded hole of the tensioner, so that a rotation of the screw in a first direction causes the spacer to move closer to the tensioner, said means being thus formed by the screw and the threaded hole.

The screw can be actuated from the outer side of the bars, for instance using a screwdriver rotating the head.

Alternatively, the screw can further comprise an end with a press-fit or threaded special plastic or metal nut with or without an inverted screw thread with a nut, or an actuating rod portion extending along a same axis as the threaded shank portion, from the end of the latter which is opposite to the end where the head is located, the actuating rod portion being adapted to, in the use position, extend out of the respective groove, on the inner side of the bars. In this case, the screw will be actuated from the inner side of the bars, by any suitable tool.

It is also disclosed herein the possibility, whether or not an inner part is present, that the device further comprises a nut adapted to be threadably engaged around the threaded shank of the screw, in the vicinity of the spacer so as to retain it in position when securing the tensioner to the bars of the frame, the nut besides being sized so as to be adapted to extend inside the grooves of the bars, and is, preferably, a round nut.

It is also disclosed herein the possibility, where or not an inner part is present, that the spacer be formed as a bar comprising a first rectilinear segment constituting the central portion of the spacer, two intermediate segments each extending from a respective end of said first segment, with forming an angle of 45-degrees with respect to said first segment, and two end segments each extending from an end of a respective intermediate segment, with forming an angle of 90-degrees with respect to said intermediate segment. The bar can have, for instance, a round or rectangular cross section.

It is also disclosed herein the possibility, whether or not an inner part is present, that the tensioner be flared U-shaped, the bottom of which is constituted by the central portion of the tensioner and each of the two legs of which are formed by a lateral portion extending from a respective end of the central portion, the tensioner being, preferably, formed by a flat part.

It is also disclosed herein, in the case where no inner part is provided, that the lateral portions of the tensioner can have a width larger than that of the spacer, in particular that of the lateral portions of the spacer, in which case said securing means are formed by said two lateral portions, for securing to the bars by force-fitting the lateral portions of the tensioner in the grooves of the bars. The width of the lateral portions of the tensioner could be, preferably, smaller in a free end region of the lateral portion than in the remainder of the lateral portion, where it is generally constant, so as to facilitate the insertion of the lateral portion in the groove of a bar.

Alternatively, still in the case where no inner part is provided, the tensioner can comprise two sheaths each defining an inner space sized to slidably receive a respective lateral portion of the tensioner, the sheath having a width that is slightly larger than that of the groove so as to be adapted to be interference fitted in the groove. Said securing means for securing the tensioner to the bars are thus formed by the lateral portions and the sheaths. In use, the sheath, preferably made of metal, will be formed as a flat case closed at one end and opened at the other end, having thin walls and a shape corresponding to that of the lateral portions, and said lateral portions will have a width slightly lower than that of the inner space of the sheaths.

It is also disclosed herein the possibility, where or not an inner part is present, that a support rib be provided, on each of the two lateral portions of the tensioner and/or of the spacer, at the center of said central portion, the support ribs being, in the use position, spacer when assembling: the lateral portions of the spacer are inserted into the grooves until the edges of the grooves abut against the support ribs. In this manner, centering the spacer correctly allows to avoid an unequal movement of the two bars, which would cause the frame to lose its rectangular shape.

The present invention also relates to a kit for assembling a frame for canvas, preferably made of wood, and for tensioning a canvas on the frame, characterized by the fact that it comprises at least four bars of frame whose ends are beveled at 45-degrees for a single-bevel type assembly between each adjacent bar and each end has a groove opening onto said end and having a bottom, preferably perpendicular to the longitudinal axis of the respective bar, and at least four above-defined devices for tensioning a canvas on a frame as defined above. The kit can comprise any number of bars and of devices for tensioning a canvas, provided that this number is a multiple of four.

The kit can also further comprise a key formed as an elongated flat part comprising a grasping portion from which extends an actuating portion, the key being, preferably, provided with a first circular through hole, for instance in the actuating portion, so as to allow the user to remove staples out of a frame bar. The user could use this key to insert, into the gap formed between two adjacent bars after the tensioning of the canvas, the corner portion of the canvas which has been let free, as will be explained more in detail below.

Advantageously, two teeth extend parallel to the longitudinal direction of the key and from the transversal free edge of the actuating portion, so as to allow the user to remove staples out of a frame bar, without substantially deforming the staples.

Finally, a second through hole, with a larger diameter, can be provided, for instance in the grasping portion, to allow the key to be hung to a support, such as for instance a conventional key holder.

It is also disclosed herein a device for tensioning a canvas on a frame, preferably made of wood, intended to assemble perpendicularly to each other two frame bars whose ends are for this purpose beveled at 45-degrees for a single-bevel type assembly of the two frame bars and each end has a groove opening onto said end and having a bottom, preferably perpendicular to the longitudinal axis of the respective bar, said device being characterized by the fact that it comprises:

a spacer, which comprises a central portion having two ends from each of which extends a lateral portion intended to be received in the groove of a respective bar among the two bars, each lateral portion having a bearing face intended to be, in the use position in which both bars are assembled, in contact, directly or indirectly, with the base of the groove, a tensioner, which comprises a central portion from which extends securing means adapted to secure, in the use position, the tensioner to the two bars, while allowing a translational movement of each bar with respect to the tensioner, along the longitudinal axis of said bar, the tensioner being positioned on the inner side of the assembled bars, a connecting member for connecting the spacer to the tensioner, and means for bringing the spacer closer to the tensioner, said means being adapted to move, in the use position, toward the tensioner the spacer which is on the outer side of the assembled bars, wherein said movement of the spacer will cause each bearing face to push, directly or indirectly, on the base of the respective groove, and thus to translate each bar along the longitudinal axis of the bar so as to space both bars apart from each other while keeping them perpendicular to each other.

The features set out above and which corresponds to the device according to the present invention as well as to a similar device but without sheath, can be combined with the device as defined in the above paragraph. It is underlined here that, in said paragraph, the term "directly" means that the spacer contacts the bottom of the groove without the interposition of a part between the spacer and the groove, and the term "indirectly" means that a part is interposed between the spacer and the bottom of groove, such as for instance an inner part as described above.

Preferably, the means for bringing the spacer closer to the tensioner protrude out of the groove of the respective bar, on the inner side of the assembled bars. In such a configuration, the means for bringing the spacer closer to the tensioner are adapted to be actuated from the inside of the frame.

DESCRIPTION OF THE DRAWINGS

FIGS. 3*a*, 3*b*, 3*c*, 3*d* are respectively side, front, back and top views of the subset of FIGS. 1 and 2;

FIG. 4 is a perspective view of the subset of FIGS. 1 and 2, according to a first implementation variant;

DETAILED DESCRIPTION OF THE PREFERRED EMBODIMENT

Figure 6A:
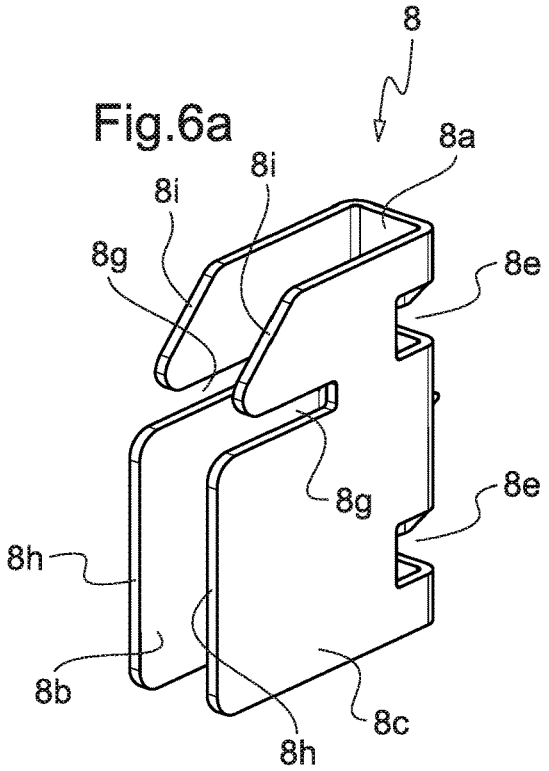
FIGS. 6*a* and 6*b* are perspective views of a sheath forming, with said subset, the device according to the present invention.

Referring first to FIGS. 1, 2 and 3*a* to 3*d*, it is shown a subset 1 forming, together with the sheath 8 shown on FIGS. 6*a* and 6*d*, the device for tensioning a canvas on a frame. The frame will be preferably made of wood, but could be made of any other material(s), for instance entirely made of plastic material (molded urethane) or made of wood with a tip made of plastic material at each end of the bars. The subset 1 comprises a spacer 2, a tensioner 3, a screw 4 and a nut 5.

The spacer 2 is formed as a rigid little bar 20 with a parallelepipedal cross section. The bar 20 thus has a so-called inner side 20*a*, an outer side 20*b* and two lateral sides 20*c*.

In particular, the bar 20 consists in five rectilinear segments connected by bends: a first segment forming the so-called central portion 21, two intermediate segments 22 each connected to a respective end of the central portion 21 by a first bend 23, and two end segments 24 each connected to a respective end of an intermediate segment 22 by a second bend 25. In the embodiment shown, each intermediate segment forms an angle of 45-degrees with the central portion 21 while each end segment 24 forms an angle of 90-degrees with the intermediate segment 22 to which it is connected. The fact that the various rectilinear segments 21, 22, 24 are connected by bends 23, 25 allows to avoid the creation of sharp edges. As shown, the bends can be simple bends, namely only formed by a curved portion, such as the bends 23, or they can be composite bends, for instance comprising two curved portion connected by a rectilinear portion of short length, such as for instance the bends 25.

In the embodiment shown on FIGS. 1, 2 and 3*a* to 3*d*, each end segment 24 constitutes the so-called lateral portion, also designed here with the reference sign 24.

Each end segment 24 has a plane face 24*a* which forms a portion of the outer side 20*b* of the spacer 20. This face 24*a* forms the so-called bearing face according to the present invention.

The above form of the bar 20 can be obtained by any suitable means. In the case of a metal bar 20, such as for instance made of steel, it can be obtained by folding of an initially rectilinear bar. It is underlined here that the bar 20 can be made of any rigid material, such as for instance of plastic material or of composite material, in which case the bar 20 can be round and the above form can be obtained, for instance, by injection, 3D printing (additive manufacturing method), etc.

A smooth cylindrical through hole 26 is provided, for example by drilling, at the center of the central portion 21, perpendicularly to the longitudinal axis of the central portion 21, from the inner side 20*a* to the outer side 20*b*.

Two rectilinear ribs 27, so-called bearing ribs, are provided, each one on a lateral side 20*c* of the bar 20, over the entire height of the lateral side 20*c*. In particular, each rib 27 is parallel to the axis of the smooth hole 26 and at the center of the central portion 21, namely the longitudinal axis of the ribs 27 and the axis of the smooth hole 26 belong to the same plane perpendicular to the longitudinal axis of the central portion 21.

The tensioner 3 is formed as a flat part 30 with a rectangular cross section, made of rigid material, said part 30 to which a flared U-shape has been conferred. The part 30 thus has a central portion, designated by 31, and two wings 32 forming two lateral portions also designated by 32. Here too, an inner side 30*a*, an outer side 30*b* and two lateral sides 30*c* for the part 30 are defined.

In a manner similar to the bar 20 forming the spacer 2, the part 30 forming the tensioner 3 can be made, for instance, of metal or of composite material.

Each wing 32 forms an angle with the central portion 31 of the tensioner 3 which is equal to that between an intermediate segment 22 and the central portion 21 of the spacer 2, namely an angle of 45-degrees.

Each wing has a free end region 32*a* which has a width lower than that of the remaining portion of the wing 32, said width being the distance between the two lateral sides 30*c*, wherein said distance is measured along a direction perpendicular to the longitudinal axis of the wing 32. In particular, the width of each wing 32 is at a first value that is constant on some length from its end connected with the central portion 31, then gradually decreases, along inclined lateral surfaces 32*b*, until the free end region 32*a* which has a globally constant width at a second value lower than the first value.

In a manner similar to the spacer 2, a threaded through hole 33 is provided at the center of the central portion 31, perpendicular to the longitudinal axis of the central portion 31, from the inner side 30*a* to the outer side 30*b*, and two ribs 34 parallel to the axis of the hole 33 and each one over the entire height of a respective lateral side 30*c*.

The screw 4 is a conventional screw and is thus formed by a screw head 41 from which extends a threaded shank 42.

The nut 5 is sized to be able to be screwed on the threaded shank 42 of the screw 41. In particular, the nut 5 is a round nut the outer diameter of which is lower than the width of the grooves 62.

The threaded shank 42, the smooth hole 26 of the spacer 2 and the threaded hole 33 of the tensioner 3 are sized so that the threaded shank 42 can be brought to pass through the smooth hole 26 and to freely rotate and slide relative to the smooth hole 26, and yet be screwed in the threaded hole 33.

In assembled position, the subset 1 is as illustrated on FIGS. 2 and 3*a* to 3*d*: the screw 4 has been threaded through the smooth hole 26, with the head screw 42 in contact with the outer side 20*b* of the spacer 2, the nut has been screwed on the threaded shank 42 until it comes in the vicinity or in contact with the inner side 20*a* of the spacer 2, then the tensioner 3 has been screwed, with its threaded hole 33, on the threaded shank 42.

Referring more specifically to FIGS. 3*b*, 3*c*, and 3*d*, it has been shown that the wings 32 of the tensioner 3 are slightly larger than the bar 20 constituting the spacer 2, except at the free end region 32*a* where they are of the same width.

Referring now to FIG. 4, it has been shown a subset 1' according to a first variant of the embodiment described above, wherein said first variant differs from said embodiment only in that the spacer 2' has a flared U-shape similar to the shape of the tensioner 3. Thus, the spacer 2' comprises three rectilinear segments: a central portion 21' and two lateral portions 22' connected by two bends 23'. The free end face 22*a'* of each lateral portion 22' will constitute a bearing face according to the present invention.

Furthermore, while the bearing ribs have been omitted on the spacer 2', obviously they could be provided.

Figure 1:
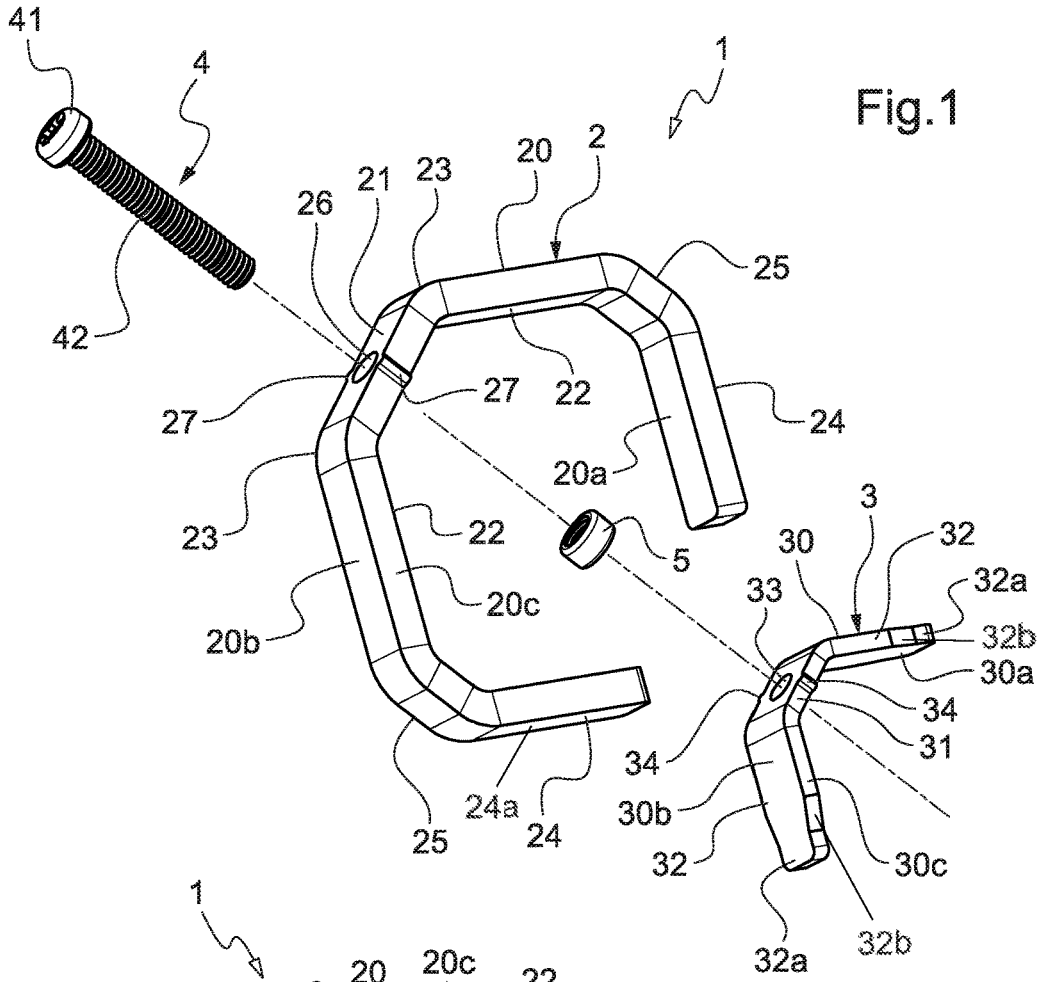
FIGS. 1 and 2 are respectively an exploded perspective view and a perspective view of a subset of the device according to a particular embodiment of the present invention.
Figure 2:
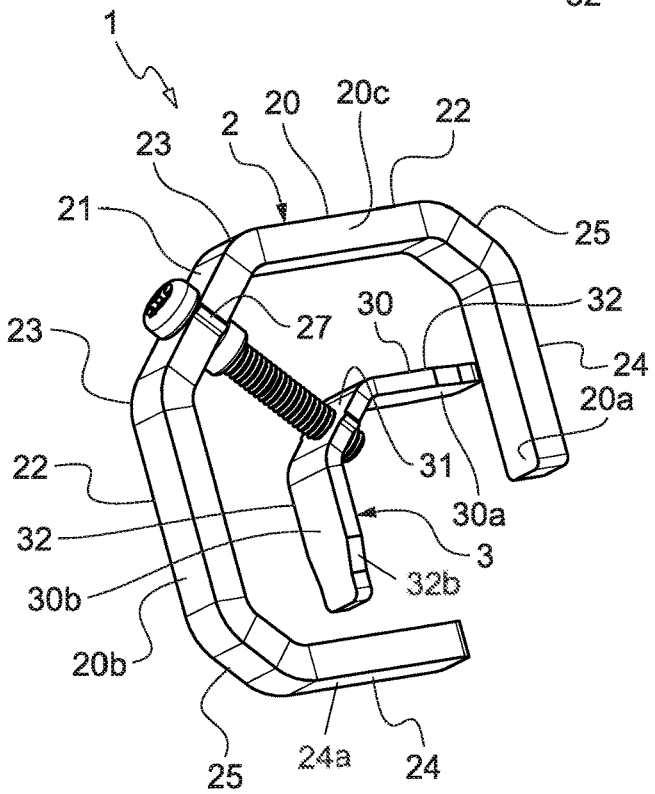
Figure 5:
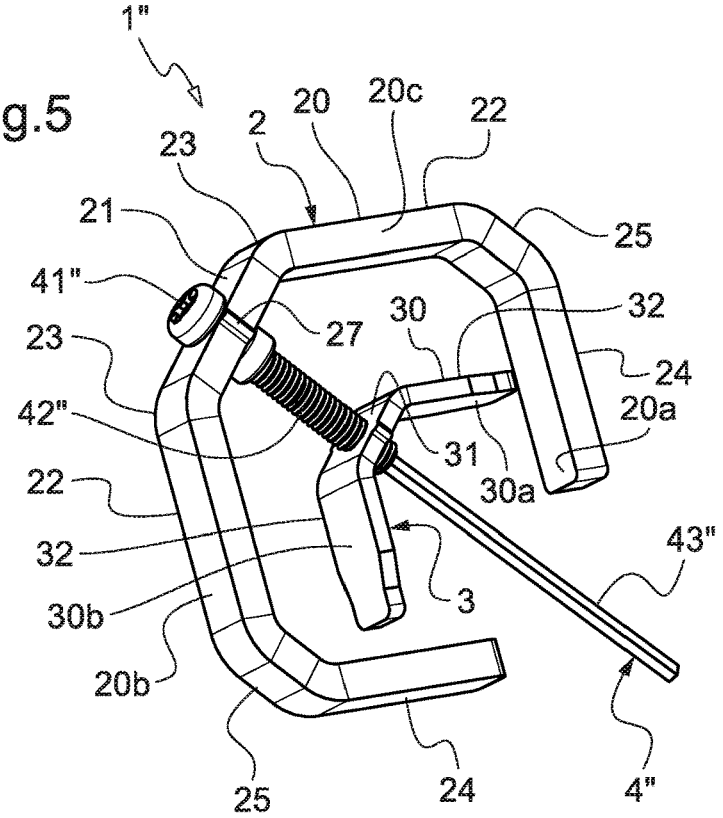
FIG. 5 is a perspective view, similar to FIG. 2, of a subset according to a second implementation variant.

Referring now to FIG. 5, it has been shown a subset 1" according to a second variant of the embodiment of FIGS. 1 to 3*d*, wherein said second variant differs from said embodiment only in that it comprises a screw 4" which itself differs from the screw 4 only in that it comprises, in addition to a head 41" and a threaded shank portion 42" similar to the head 41 and to the threaded shank 42, respectively, a so-called actuating rod portion 43".

The actuating rod portion 43" extends along the same axis as the threaded shank portion 42", from the end of the thread shank portion 42" which is opposite to the end where the head 41" is located. In the variant shown, the actuating rod portion 43" has a square cross section.

Figure 15:
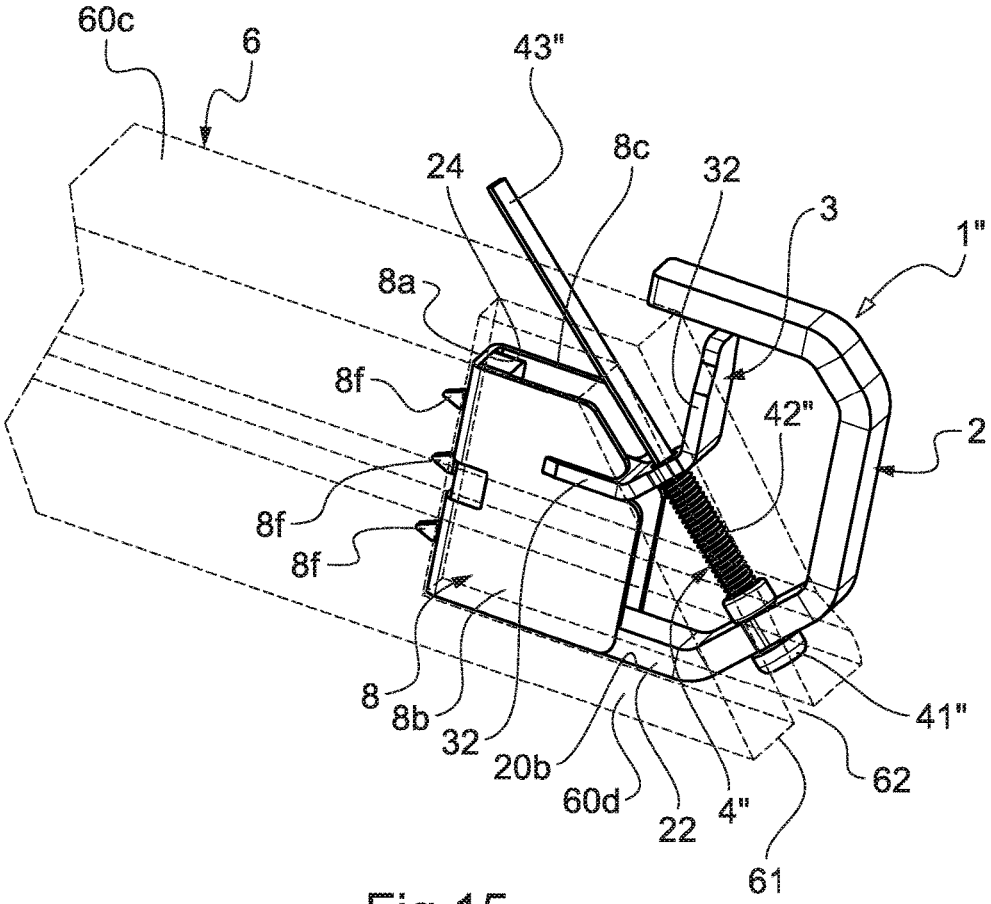
FIG. 15 is a perspective view showing the device according to the present invention, with a screw for actuating from the inner side, fitted in a frame bar.

As it can be better seen on FIG. 15, the actuating rod portion 43" is sized, in particular for its length, so that after the device has been placed in a frame bar, the free end region of the actuating rod portion 43" extends out of the bar, so as to be actuatable by the user, for instance using a key with a form corresponding to the cross section of the actuating rod portion 43".

Figure 6B:
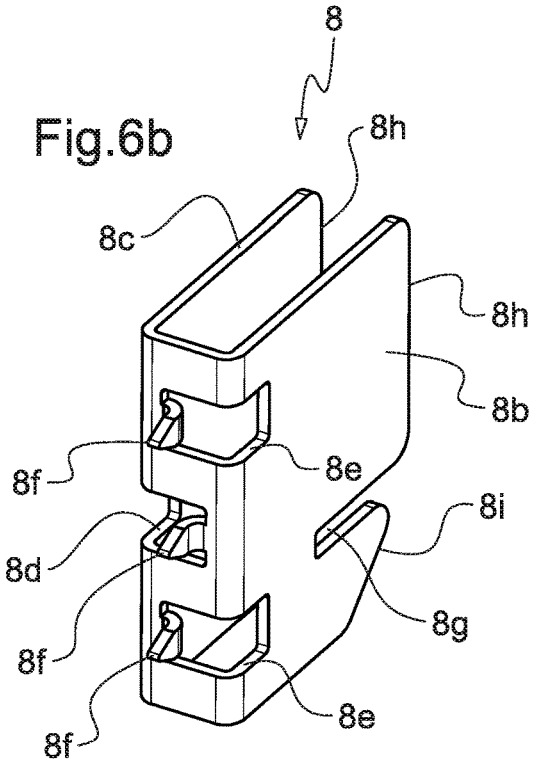

Referring now to FIGS. 6*a* and 6*b*, it has been shown a particular embodiment of the inner part according to the present invention, which is here a sheath 8 forming, together with a subset 1, 1' or 1", a device according to the present invention. As it can be seen on FIG. 15, the sheath 8 is intended to be placed in a corresponding groove of a bar.

The sheath 8 is formed as a part of a globally U-shaped plate type, for instance obtained by folding a plate. The sheath 8 comprises thus a bottom 8*a* from which extends two wings 8*b*, 8*c*.

The "longitudinal direction" of the sheath 6 shall mean the direction perpendicular to the bottom 8*a*, the "transversal direction" shall mean the direction perpendicular to the longitudinal direction of the sheath 6 and to the wings 8*b*, 8*c*, and the "height direction" shall mean the direction perpendicular to the longitudinal direction and to the transversal direction.

The sheath 8 is provided with a first aperture 8*d* made in the bottom 8*a* and the wing 8*c*, and two second apertures 8*e* made in the bottom 8*a* and the wing 8*b*. The first aperture 8*d* is located at the center of the sheath 8, in the height direction, while a second aperture 8*e* is provided in each of the two end regions of the sheath 8 in the height direction. The first and second apertures 8*d*, 8*e* are rectangular. The first aperture 8*d* is defined by a first edge parallel to the height direction and in the vicinity of the wing 8*b*, two edges parallel over the entire width (transversal direction) of the bottom 8*a* then in the wing 8*c*, over a small distance in the longitudinal direction. Each second aperture 8*e* is similar to the first aperture 8*b*, with the difference that they each start from the vicinity of the wing 8*c* and extends up into the wing 8*b*. The apertures 8*d*, 8*e* confer to the sheath 8 a slight elasticity which facilitates the insertion of the sheath 8 in a bar groove, by allowing the wings 8*b*, 8*c* to slight get closer from one another during said insertion, as well as the retaining of the sheath 8 in said groove, the wings 8*b*, 8*c* pressing back against the inner faces of the groove.

Furthermore, for each aperture 8*d*, 8*e*, a material strip extends from the edge of the aperture 8*d*, 8*e* that is located in the bottom 8*a*, and the material strip is bent at right angle outwardly of the sheath 8, namely opposite to the wings 8*b*, 8*c*, so as to form a tapered tooth 8*f*, here as a triangular tooth when seen from the side (transversal direction). The teeth 8*f* are adapted to sink into the bottom of a bar groove so as to immobilize the sheath 8 in said bar.

In addition, a rectangular cutout 8*g* is provided on each wing 8*b*, 8*c*, each cutout 8*g* extending in the longitudinal direction of the sheath 8, from the free edge, namely distant from the bottom 8*a*, over a distance here slightly more than half of the length of the wing 8*b*, 8*c*.

As it can be seen on FIG. 15, the cutouts 8*g* have a width slightly larger than the width of the wings 32 of the tensioner 3 so as to form a guiding track for the wings edges 32. The portion 8*h* of the free edge of each wing 2*b*, 2*c* is, on a side of the respective cutout 8*g* which will be located on the outer side of the frame once the sheath 8 is placed in the bar groove, parallel to the bottom 8*a*, while the portion 8*i* of the free edge on the other side of the cutout 8*g*, therefore on the inner side of the frame, is beveled at 45-degrees to follow the bevel of the bar as it will be described hereafter.

The sheath 8 could be made, for instance, of metal or of composite material.

The principle for the tensioning of a painter's canvas according to the present invention will now be described with reference to FIGS. 7 to 10. It is underlined here that, although for the sake of clarity of the Figures only one subset 1 has been shown on FIGS. 7 to 9, without the sheath 8, the operating principle stays the same when the inner part (sheath 8) is provided.

Figure 10:
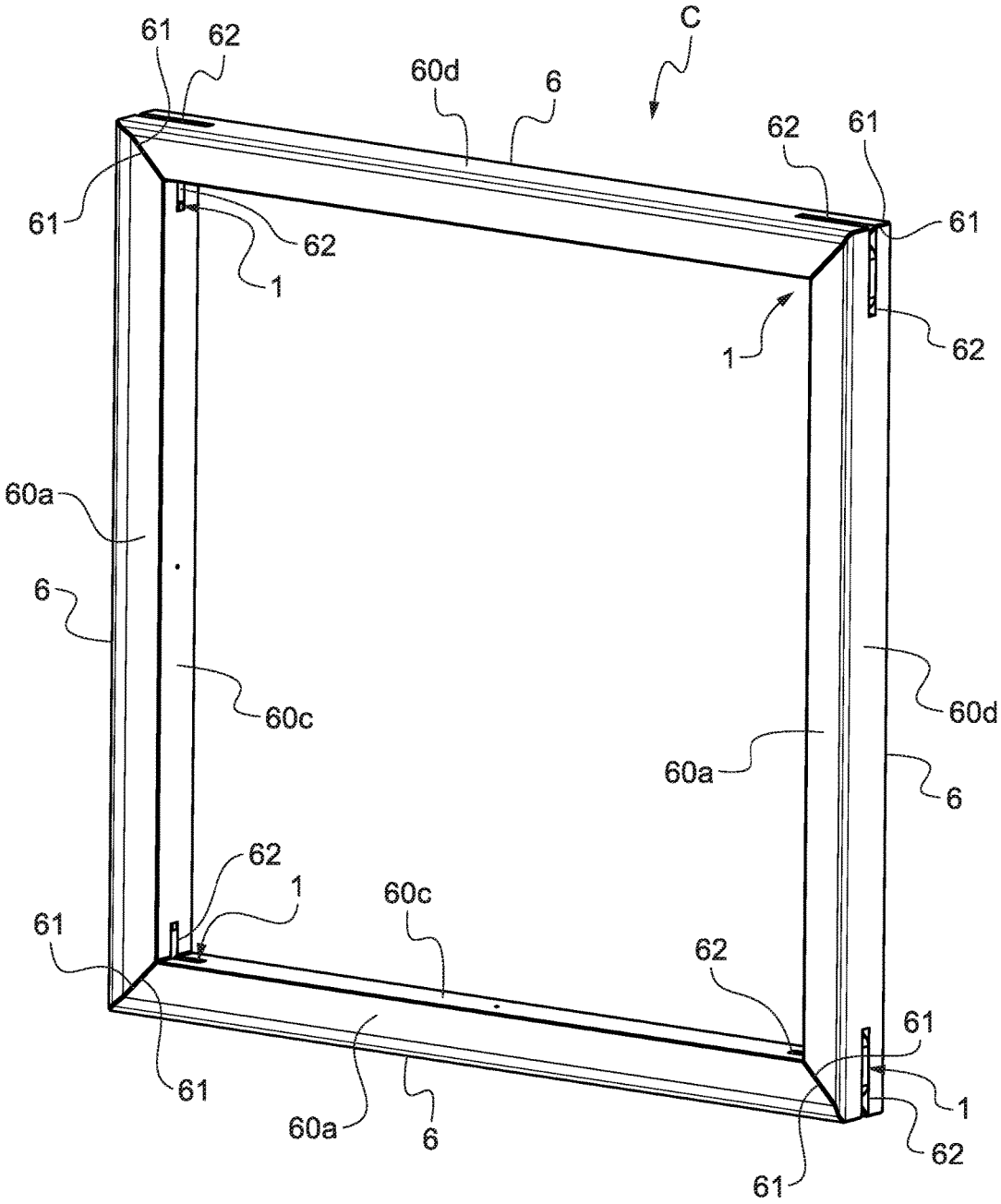
FIG. 10 is a perspective view of a frame assembled by four devices according to the present invention, in an initial position.
Figure 11:
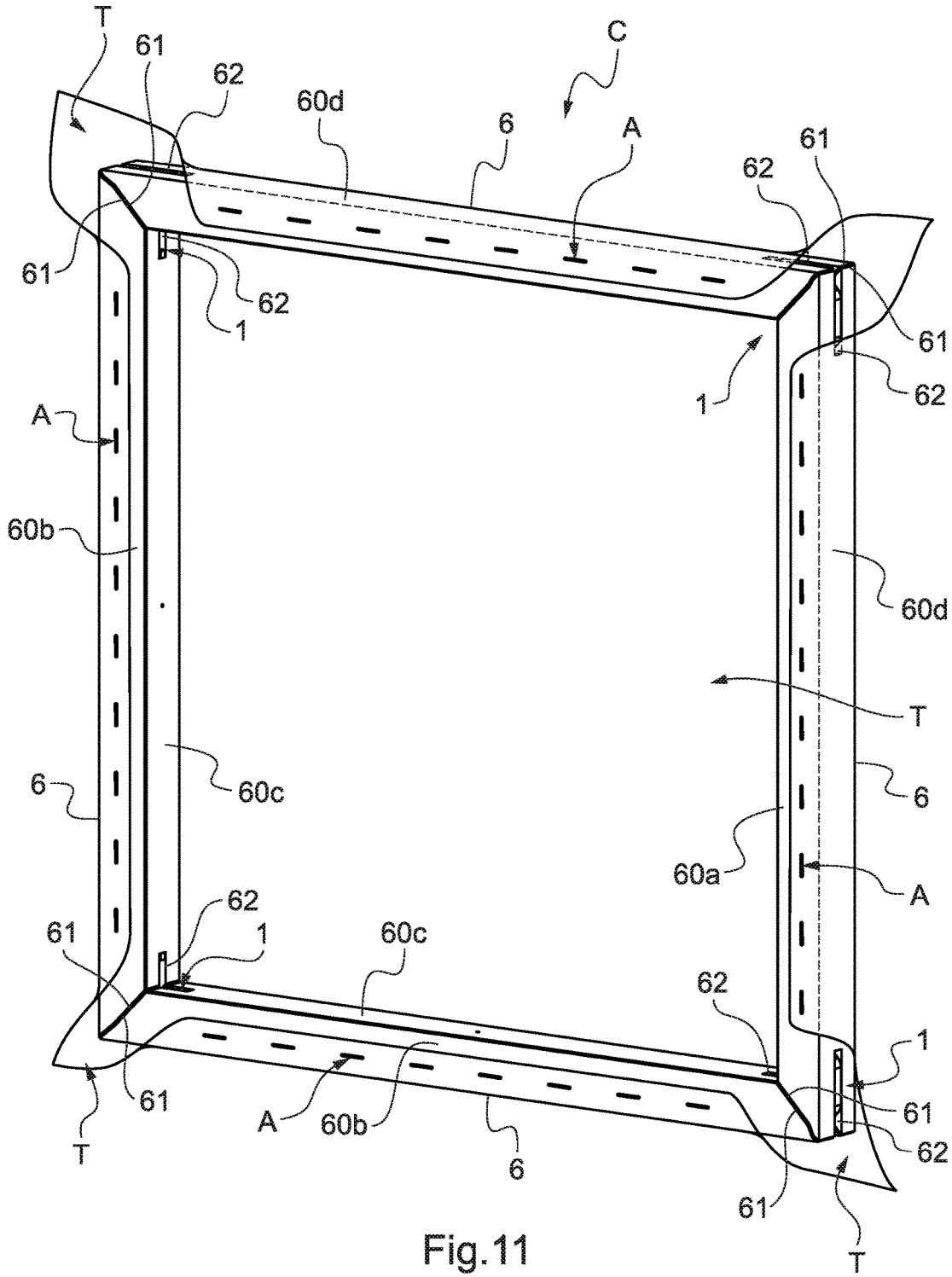
FIG. 11 is a perspective back view of a canvas stitched on the frame of FIG. 10.
Figure 12:
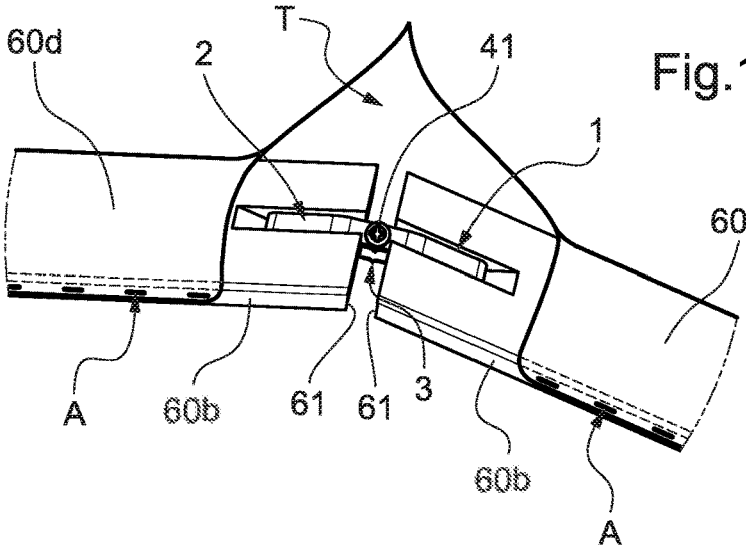
FIG. 12 is a side view of a corner of the frame of FIG. 11, before the tensioning.

Referring first to FIG. 10, it can be seen that a frame C for canvas according to the present invention is formed by four bars 6 each having two ends 61 beveled at 45-degrees. At each end 61 is provided, parallel to front 60*a* and back 60*b* sides of the bar 6, a rectilinear through groove 62 of the mortise type, namely the groove 62 has a constant width and opens both onto the inner side 60*c* and onto the outer side 60*d* of the bar 6.

Figure 7:
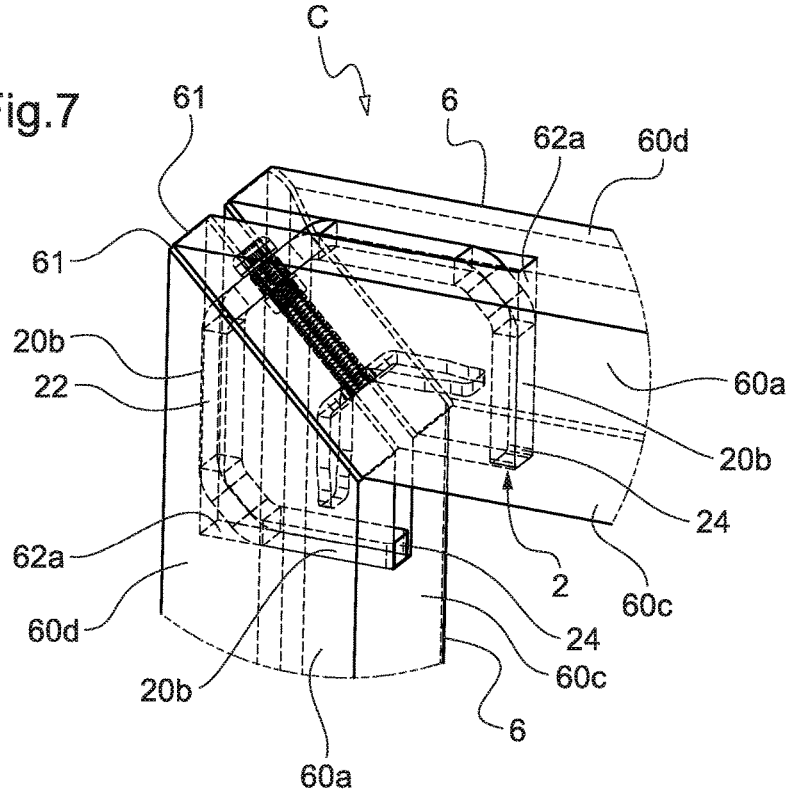
FIGS. 7 and 8 are respectively a perspective view and a plan view of the corner of a frame equipped with a subset of FIGS. 1 and 2, before the tensioning of a canvas.

As it can be seen on FIG. 7, which is an enlarged view of the left top corner of the frame C of FIG. 10, a first function of the subset 1 according to the present invention is to assemble with one another two bars 6 arranged at 90-degrees with respect to one another. To that end, the subset 1 is sized according to the bars 6 to be assembled: the width of the grooves 62 is at least slightly larger than the width of the spacer 2 but, due to the absence of the sheath 8, is slightly lower than the width of the wing 32 of the tensioner 3, for the reasons which will be clarified hereafter. Furthermore, the depth of the grooves 62 is such that the bearing faces 24*a* of the lateral portions 24 of the spacer 2 are in contact with the bottom 62*a* of the grooves 62.

The assembly can be done as follows: first, the user takes a first bar 6 and sinks a wing 32 of a tensioner 3 in each of the two grooves 62, one after the other, until the ribs 34 abut against the end faces of the first bar 6. Since the width of the wing 32 is slightly larger than that of the groove 62, this insertion is made at least slightly forcibly, so that the tensioners 3 and the bar 6 cannot move with respect to each other only in the longitudinal direction of the bar 6. The tensioner 3 is located closer to the inner side of the assembled bars 6 than to the outer side. In the case where, as indicated above, each wing 32 is covered with a sheath, it is the sheath that will be sunk in the respective groove 62, the free end of each wing 32 pushing on the closed bottom of the sheath. As it will be described hereafter, each wing 32 will be able to translate in the respective sheath, while said sheath will stay immobilized in the groove 62. It is underlined here that using such sheaths allows to simplify the assembling and disassembling by the user: once the sheaths are sunk in the grooves, the user will be able to separate the tensioner 3 from the bars 6 (disassembling operation) and to reinsert the tensioner 3 in the bars 6 (assembling operation) without having to exert an effort, since the wings will slide smoothly in the respective sheaths. Furthermore, the sheaths define the correct position for the tensioner 3, and thus one can be sure that the tensioner 3 is correctly positioned in the assembling operation.

Referring back to FIG. 7, in this position, the spacers 2 are also located in the grooves 62, with each bearing face 24*a* against the bottom 62*a* of the groove 62 and the ribs 27 also bearing against the end faces 61 of the bar 6. In the example shown, the spacer 2 is sized so that in the initial position, the free end face of each lateral portion 24 is located generally in the plane of the inner side 60*c* of the first bar 6 and the outer side 20*b* of the intermediate segment 22 is located generally in the plane of the outer side 60*d* of the first bar 6.

it can be underlined here that the ribs 27 and 34 allow to facilitate centering the spacer 2 and the tensioner 3 in the grooves 62.

The user proceeds in the same manner as above on a second bar 6.

Then, the user force-fits a first end of the third and fourth bars 6 on the free wings 32 of the tensioner 3 already assembled on the first bar 6. The spacers 2 are then received in the grooves 62 of the third and fourth bars 6, which is possible because the round nut 5 has an outer diameter lower than the width of the grooves 62.

It is underlined here that the force-fitting of the wings 32 in the grooves 62 is facilitated by the presence of the inclined lateral surfaces 32*b* and of the free end regions 32*a* of a smaller width, so that the user is not required to exert a great effort, and thus allowing him to correctly position the tensioner 3. The presence of the nut 5 allows to retain in position the spacer 2 and the screw 4 during this force-fitting.

It is mentioned here that according to the present invention one can contemplate, in case an inner part is not used, to machine in advance, in the lateral walls of the grooves 62, two rectilinear notches facing each other and into which the user could slide the wings edges, without force-fitting.

Finally, the user inserts simultaneously and forcibly in the grooves 62 of the second ends of the third and fourth bars 6 the tensioners 3 already fitted in the second bar 6, and thus obtains the frame C as shown on FIG. 10.

It is underlined here that one of the advantages of the present invention is that the subset 1 allows to assemble and thus to maintain in position the bars: the various bars 6 are thus maintained in the assembled state during assembly of the frame C and, although a slight deformation of the deformable parallelogram type may be encountered with the frame C once it is assembled, in particular for the frame of a larger size, the frame C stays in one-piece and may be manipulated by the user with only one hand, without requiring the user to hold the frame C with his other hand to maintain it assembled.

Figure 8:
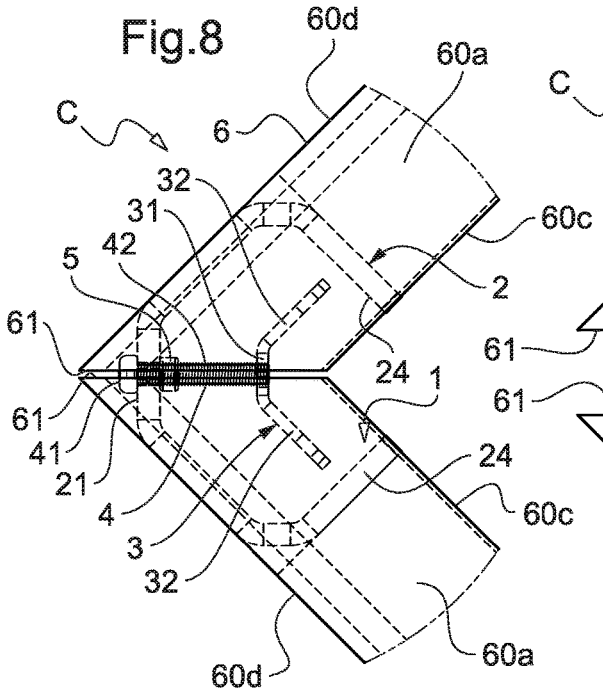

Once the subsets 1 are all placed in the position of FIGS. 7 and 8, they can be each actuated to enlarge the frame C, and thus tension a canvas fixed on it, simply by rotating the screw 4.

Indeed, it is easily understood that the user could rotate the screw 4 with a screwdriver, the head screw 41 of said screw 4 being reachable from the outside of the frame C through the grooves 62, and that the rotation of the screw 4 in a first direction, in particular the clockwise direction, will cause it to translate toward the tensioner 3 (namely toward the center of the frame C) because the tensioner 3 is fixed, and thus serves as an anchor, while the rotation of the screw 4 in the opposite direction will translate it in the opposite direction.

Figure 9:
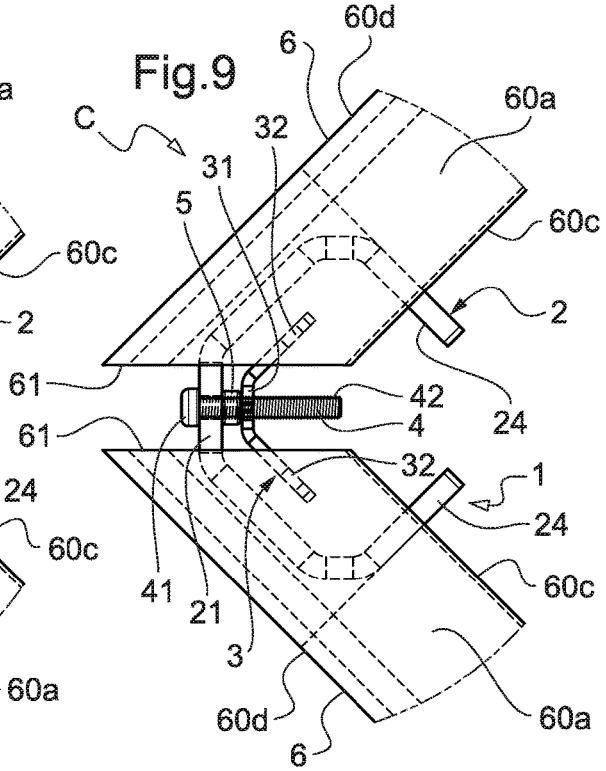
FIG. 9 is a view similar to FIG. 8, after the tensioning of a canvas.

With further reference to FIG. 9, it is easily understood that when the screw 4 is moved toward the tensioner 3, the head screw 41 will push the spacer 2 closer to the tensioner 3. Since the spacer 2 is in contact by its bearing faces 24*a* with the bottom of the grooves 62, the movement of the spacer 2 toward the tensioner 3 results in the two bars 6 being spaced apart from each other: the spacer 2 will slide in the grooves 62 with bearing on the bottom 62*a* thereof, which will force the bars 6 to translate, with respect to the respective wing 32, in the longitudinal direction of the respective bar 6. Thus, the bars 6 are spaced from one another while remaining perpendicular to each other, as it can be better seen on FIG. 7.

The implementation variant of the device 1' illustrated on FIG. 4 operates on the same principle as the one described above: the spacer 2' is sized so that in initial position the bearing faces 22*a'* are in contact with the bottom 62*a* of the grooves 62, so that they will space part the bars 6 after rotation of the screw 4 in the clockwise direction.

It is underlined here that the embodiment of the subset 1 of FIGS. 1 to 3*d* has, with respect to this implementation variant, the advantage to provide bearing faces which have a bigger contact surface, in particular over a greater length of the groove 62, which allows to improve the stability of the assembly and to ensure that the frame C keeps a rectangular shape while limiting a deformation of the deformable parallelogram type.

The installation and tensioning method of a painter's canvas on the frame C will now be described with reference to FIGS. 10 to 13.

First, the user assembles the frame C as described above, with the subsets 1 in initial position.

In a conventional manner, the user will apply a canvas T on the front sides 60*a* of the frame C, and will fold down the canvas T along the outer sides 60*d* and then the back sides 60*b*, before fixing the canvas T on the frame C with any suitable means, such as for instance by stapling. The fixing will be performed along the bars 6, however while letting free the canvas T in the region of each corner of the frame C, so as to obtain a frame C and a canvas T such as shown on FIGS. 9 and 10.

The user then actuates the subsets 1 so as to tension the canvas T to the desired tension value. Preferably, the user will actuate successively, and in an equal manner, a first subset 1 to slightly space apart the bars 6 which are assembled by said first subset 1, then a second subset 1, then a third subset 1 and a fourth subset 1, before going back to the first subset 1 to actuate it. The use can proceeds as above iteratively until the desired tension value is reached.

Once the canvas T is correctly tensioned, the user only has to either fold on the back of the frame C the free portion of the canvas T so as to form folds which overlap, and then fix the folds to the back of the frame C by stapling, or insert the free portion of the canvas T in the gap between two adjacent bars, said gap created as a result of the bars being spaced apart, using any suitable means, such as for instance the screwdriver which was used to actuate the screws 4.

Figure 13:
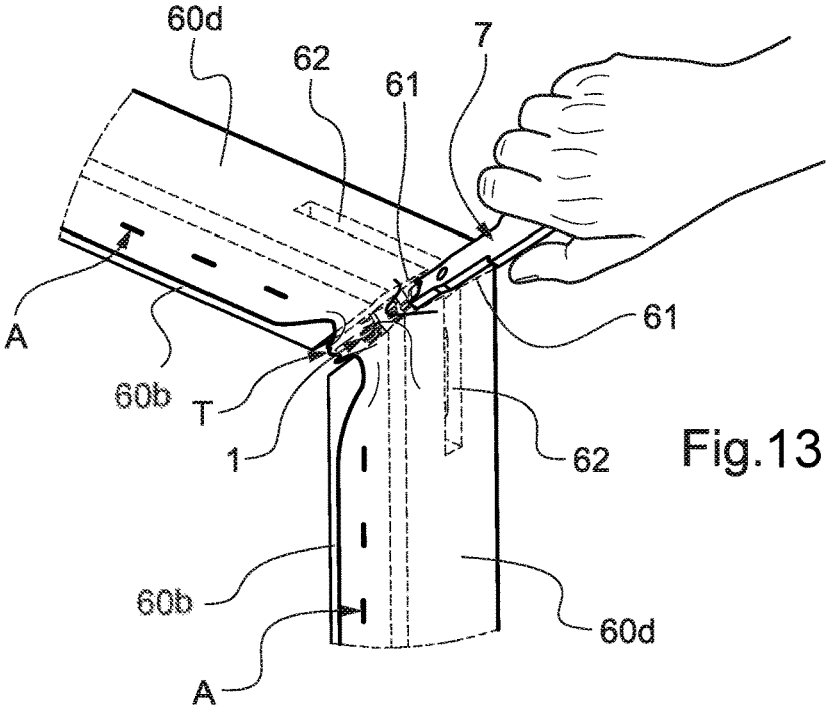
FIG. 13 is a perspective view of the corner of FIG. 12, showing the last step consisting in inserting between the bars the remaining part of the canvas.
Figure 14:
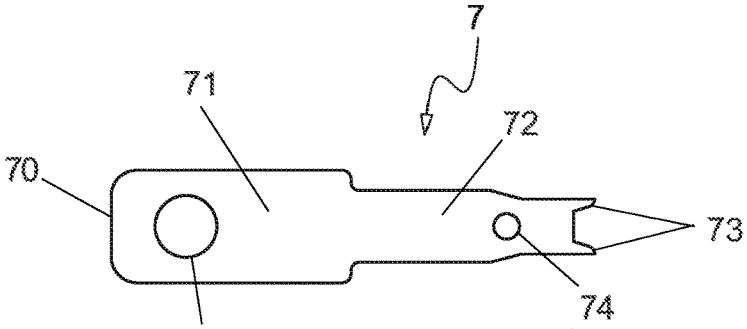
FIG. 14 is a plan view of the key according to the present invention.

For this last step, as shown on FIG. 13, a key 7 according to the present invention, shown in a plan view on FIG. 14, could be used. This key is formed as an elongated flat part 70 with a thickness sufficiently small so that it can be inserted in the gap created between two adjacent bars as illustrated on FIG. 13. The key 7 comprises a grasping portion 71, with which the key 7 may be grasped by the user, and an actuating portion 72, which has in the example shown a width lower than that of the grasping portion 71.

Two generally triangular teeth 73 extends from the transversal free edge of the actuating portion 72, said teeth 73 with which the user could remove staples out of a bar 6 without substantially deforming the staples.

Furthermore, a first circular through hole 74 is provided in the actuating portion 72, said hole 74 has a small diameter chosen so that it can be used by the user to remove staples out of a bar 6.

Finally, a second circular through hole 75, with a diameter larger than the hole 74, is provided in the grasping portion 71, said hole 75 with which the key 7 could be hung to a support, such as for instance a conventional key holder.

In the example shown on FIGS. 7 to 11, the subset 1 is actuated from the outer side of the frame C, namely by acting on the head 41 of the screw 4. As it can be seen on FIG. 15, the subset 1" according to the second variant allows actuating from the inner side of the frame C, since the actuating rod portion 43" has a length sufficient to protrude out of the groove 62, on the inner side 60*c* of the bar 6, and thus to be actuated by the user by any suitable means, such as for instance an open-ended spanner, a ring spanner, a crescent wrench, etc.

Still with reference to FIG. 15, it can be seen that, according to the present invention, before inserting the tensioner 3 in the groove 62, the sheath 8 is force-fitted in the groove 62. The sheath 8 is sized in length (longitudinal direction), in width (transversal direction) and in height (height direction) according to the dimensions of the groove 62: in a correctly placed position, the outer surface of the bottom 8*a* is in contact with the bottom 62*a* of the groove 62, the outer surfaces of the wings 8*b*, 8*c* are in contact with the edges of the groove 62, the portion 8*i* of the free edge of each wing 8*b*, 8*c* is flush with the face of the beveled end 61, and the edge connecting the bottom 8*a* with the portion 8*h* of the free edge of each wing 8*b*, 8*c* is located generally in the plane of the outer side 60*d* of the bar 6, as the outer side 20*b* of the intermediate segment 22.

The sheath 8 is firmly secured in position in the groove 62 by the teeth 8*f* sunk in the bottom 62*a* of the groove 62.

Fitting the sheath 8 can be performed by the manufacturer or by the user.

With the sheath 8 in position in the groove 62, the user can insert the tensioner 3 in the sheath 8, by sliding the edges of the wings 32 of the tensioner 3 in the cutouts 8*g*. The presence of the sheath 8 has the advantages that the user does not have to force-fit the tensioner in the groove 62, or notches don't have to be machined in advance, and that the position of the tensioner 3 with respect to the bar 6 is necessarily correct, because it is defined by the cutouts 8*g*, without the possibility for the user to depart from it, which could be the case when the user force-fits the tensioner 3 directly in the groove 62. This is true in general whatever the guiding formation is, and not only for a guiding formation consisting in a cutout 8*g*.

Furthermore, the spacer 2 is then sized so as to be inserted in the sheath 8, and so that it will be always in contact with the bottom 62*a* of the groove 62, in an indirect manner via the bottom 8*a* of the sheath 8, and no more directly as in FIGS. 7 to 9. As indicated above, the operating principle remains the same, and actuating the screw 4" in a direction will bring the adjacent bars 6 closer.

Obviously, it is understood that the specific embodiment and its variants which have been described above have been given for information purposes only and that modifications may be made without departing from the scope of the present invention.

What is claimed is:

1. A device for tensioning a canvas on a frame, preferably made of wood, intended to assemble perpendicularly to each other two frame bars, whose ends are for this purpose beveled at 45-degrees for a single-bevel type assembly of the two frame bars and each end has a groove opening onto said end and having a bottom perpendicular to the longitudinal axis of the respective bar, said device comprising:

a spacer, which comprises a central portion having two ends from each of which extends a lateral portion intended to be received within the groove of a respective bar among the two bars, each lateral portion having a bearing face intended to be, in the use position, in which both bars are assembled, in contact with the bottom of the groove, a tensioner, which comprises a central portion from which extends securing means adapted, in the use position, to secure the tensioner to the two bars, while allowing a translational movement of each bar with respect to the tensioner, along the longitudinal axis of said bar, the tensioner being positioned on the inner side of the assembled bars, a connecting member for connecting the spacer to the tensioner, and means for bringing the spacer closer to the tensioner, said means being adapted to move, in the use position, toward the tensioner the spacer which is on the outer side of the assembled bars, wherein said movement of the spacer will cause each bearing face to push on the bottom of the respective groove, and thus to translate each bar along the longitudinal axis of the bar so as to space both bars apart from each other while keeping them perpendicular to each other;

wherein the central portion of the spacer has in its center a smooth through hole, the central portion of the tensioner has in its center a threaded through hole which is aligned, in the use position, with said smooth through hole, the connecting member being a screw having a screw head and a threaded shank sized to extend in a freely rotating and slidable manner in the smooth through hole of the spacer and then to be threadably engaged with the threaded hole of the tensioner, so that a rotation of the screw in a first direction causes the spacer to move closer to the tensioner, said means being thus formed by the screw and the threaded hole.

2. The device for tensioning a canvas on a frame according to claim 1, wherein the device further comprises a nut adapted to be threadably engaged around the threaded shank of the screw, in the vicinity of the spacer, so as to retain it in position when securing the tensioner to the bars of the frame, the nut besides being sized so as to be adapted to extend inside the grooves of the bars, and is, preferably, a round nut.

3. The device for tensioning a canvas on a frame according to claim 1, wherein the spacer is formed as a bar comprising a first rectilinear segment constituting the central portion of the spacer, two intermediate segments each extending from a respective end of said first segment, with forming an angle of 45-degrees with respect to said first segment, and with, or without, two end segments each extending from an end of a respective intermediate segment, with forming an angle of 90-degrees with respect to said intermediate segment.

4. The device for tensioning a canvas on a frame according to claim 1, characterized in that the tensioner is flared U-shaped, the bottom of which is constituted by the central portion of the tensioner and each of the two legs of which are formed by a lateral portion extending from a respective end of the central portion, said securing means being formed by said two lateral portions, the tensioner being, preferably, formed by a flat part.

5. The device for tensioning a canvas on a frame according to claim 4, wherein lateral portions of the tensioner have a width larger than that of the spacer, in particular that of the lateral portions of the spacer, for securing to the bars by force-fitting the lateral portions of the tensioner in the grooves of the bars.

6. The device for tensioning a canvas on a frame according to claim 4, wherein the width of the lateral portions of the tensioner is smaller in a free end region of the lateral portion than in the remainder of the lateral portion, where it is generally constant, so as to facilitate the insertion of the lateral portion in the groove of a bar.

7. The device for tensioning a canvas on a frame according to claim 1, wherein a support rib is provided on each of the two lateral portions of the tensioner and/or of the spacer, at the center of said central portion, the support ribs being, in the use position, parallel to the connecting member.

8. A kit for assembling a frame for canvas, preferably made of wood, and for tensioning a canvas on the frame, wherein the kit comprises at least four of the devices for tensioning a canvas on a frame as defined in claim 1, and at least four bars of frames, the ends of which are beveled at 45-degrees for a single-bevel type assembly between each adjacent bar, each end having a groove opening onto said end and having a bottom perpendicular to the longitudinal axis of the respective bar.

9. The kit according to claim 8 further including a key formed as an elongated flat part comprising a grasping portion from which extends an actuating portion, the key being, preferably, provided with a first circular through hole, so as to allow the user to remove staples out of a frame bar.

10. The kit according to claim 9 wherein two teeth extend parallel to the longitudinal direction of the key and from the transversal free edge of the actuating portion, so as to allow the user to remove staples out of a frame bar, without substantially deforming the staples.

11. A device for tensioning a canvas on a frame, preferably made of wood, intended to assemble perpendicularly to each other two frame bars, whose ends are for this purpose beveled at 45-degrees for a single-bevel type assembly of the two frame bars and each end has a groove opening onto said end and having a bottom, preferably perpendicular to the longitudinal axis of the respective bar, said device comprising:

at least a so-called inner part having a base from which extends at least a wing, the inner part being configured to be, in a use position, immobilized within the groove of a bar with the base being in contact with the bottom of the groove, the at least one wing having at least one guiding formation, a spacer, which comprises a central portion having two ends from each of which extends a lateral portion intended to cooperate with an inner part immobilized within the groove of a respective bar among the two bars, each lateral portion having a bearing face intended to be, in the use position in which both bars are assembled, in contact with the base of the inner part, a tensioner, which comprises a central portion from which extends securing means adapted to cooperate, in the use position, with said guiding formation in order to secure the tensioner to the two bars, while allowing a translational movement of each bar with respect to the tensioner, along the longitudinal axis of said bar, the tensioner being positioned on the inner side of the assembled bars, a connecting member for connecting the spacer to the tensioner, and means for bringing the spacer closer to the tensioner, said means being adapted to move, in the use position, toward the tensioner the spacer which is on the outer side of the assembled bars, wherein said movement of the spacer will cause each bearing face to push on the base of the inner part, and so on the bottom of the respective groove, and thus to translate each bar along the longitudinal axis of the bar so as to space both bars apart from each other while keeping them perpendicular to each other.

12. The device for tensioning a canvas on a frame according to claim 11, wherein the inner part is formed as a globally U-shaped sheath, having thus a bottom forming said base and two wings, at least one of the two wings being provided with a guiding formation.

13. The device for tensioning a canvas on a frame according to claim 12, wherein:

the tensioner has a flared U-shape, whose bottom is constituted by the central portion of the tensioner and whose two legs are each formed by a lateral portion which has two lateral edges and extends from a respective end of the central portion, said securing means being formed by said two lateral portions, and the at least one guiding formation is sized so as to allow a respective side edge of a lateral portion of the tensioner to slide relative to said guiding formation.

14. The device for tensioning a canvas on a frame according to claim 13, wherein each wing comprises a guiding formation formed by a cutout provided in the respective wing, each cutout extending along a direction perpendicular to the bottom of the sheath and opening onto the free edge of the respective wing, each cutout being sized so as to allow a respective lateral edge of a lateral portion of the tensioner to slide in said cutout.

15. The device for tensioning a canvas on a frame according to claim 12, wherein the sheath is provided with apertures arranged in the bottom and at least one of the wings.

16. The device for tensioning a canvas on a frame according to claim 15, wherein the inner part is provided with at least one securing member adapted to secure the inner part to the groove of the respective bar, the at least one securing member preferably being a tooth, in particular sharp, extending outwardly from the base of the inner part.

17. The device for tensioning a canvas on a frame according to claim 16, comprising a plurality of securing members, each one formed by a material strip which extends transversely to a respective one of said apertures and which is bent at right angle outwardly.

18. The device for tensioning a canvas on a frame according to claim 11, wherein the central portion of the spacer has in its center a smooth through hole, the central portion of the tensioner has in its center a threaded through hole which is aligned, in the use position, with said smooth through hole, the connecting member being a screw having a screw head and a threaded shank portion sized to extend in a freely rotating and slidable manner in the smooth through hole of the spacer and then to be threadably engaged with the threaded hole of the tensioner, so that a rotation of the screw in a first direction causes the spacer to move closer to the tensioner, said means being thus formed by the screw and the threaded hole.

19. The device for tensioning a canvas on a frame according to claim 18, wherein the screw further comprises an actuating rod portion extending along a same axis as the threaded shank portion, from the end of the latter which is opposite to the end where the head is located, the actuating rod portion being adapted to, in the use position, extend out of the respective groove, on the inner side of the bars.

20. A kit for assembling a frame for canvas, preferably made of wood, and for tensioning a canvas on the frame, comprising at least four devices for tensioning a canvas on a frame according to claim 11, and at least four bars of frame whose ends are beveled at 45-degrees for a single-bevel type assembly between each adjacent bar and each end has a groove opening onto said end and having a bottom, preferably perpendicular to the longitudinal axis of the respective bar.

* * * * *